US009730558B2

(12) United States Patent
McNulty et al.

(10) Patent No.: US 9,730,558 B2
(45) Date of Patent: Aug. 15, 2017

(54) PRODUCT DISPENSER WITH PRESSURE RELIEF

(71) Applicant: GOJO Industries, Inc, Akron, OH (US)

(72) Inventors: John J. McNulty, Broadview Heights, OH (US); Donald R Harris, Tallmadge, OH (US); Aaron D. Marshall, Uniontown, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 14/711,497

(22) Filed: May 13, 2015

(65) Prior Publication Data

US 2015/0327730 A1 Nov. 19, 2015

Related U.S. Application Data

(60) Provisional application No. 61/993,816, filed on May 15, 2014.

(51) Int. Cl.

| | |
|---|---|
| ***A47K 5/14*** | (2006.01) |
| ***B05B 11/00*** | (2006.01) |
| *A47K 5/12* | (2006.01) |
| *B05B 7/00* | (2006.01) |
| *B67D 3/04* | (2006.01) |

(Continued)

(52) U.S. Cl.

CPC ..... *A47K 5/14* (2013.01); *B05B 7/0037* (2013.01); *B05B 11/007* (2013.01); *B05B 11/0018* (2013.01); *B05B 11/3087* (2013.01); *A47K 5/1211* (2013.01); *A47K 5/1217* (2013.01); *A47K 2005/1218* (2013.01); *B05B 1/323* (2013.01); *B05B 7/0018* (2013.01); *B05B 9/047* (2013.01); *B05B 9/0413* (2013.01); *B05B 11/0062* (2013.01); *B67D 3/042* (2013.01); *B67D 3/043* (2013.01)

(58) Field of Classification Search

CPC ..... A47K 5/14; A47K 5/1217; A47K 5/1211; A47K 2005/1218; B05B 11/3087; B05B 11/0018; B05B 11/007; B05B 1/32; B05B 1/323; B05B 7/0037; B05B 7/0018; B05B 7/045; B05B 11/0062; B67D 3/041–3/043

USPC ..... 222/190, 333–334, 145.5–145.6, 222/325–327, 490, 108–111, 571

See application file for complete search history.

(56) References Cited

U.S. PATENT DOCUMENTS 5,133,500 A * 7/1992 Simpson ..... B05B 7/262 239/150

5,842,607 A * 12/1998 Snider ..... A45D 27/10 222/145.6

(Continued)

*Primary Examiner* — Paul R Durand

*Assistant Examiner* — Andrew P Bainbridge

(74) *Attorney, Agent, or Firm* — Calfee, Halter & Griswold LLP

(57) ABSTRACT

A fluid product dispensing system includes a liquid pump and a pneumatic pump that forces fluid product and pressurized air through a foaming device. The foam mixture forces a dispensing valve, located downstream, to open and thereby distribute product onto a user's hands. A control system turns off the pumps and open a pressure relief valve in the pneumatic conduit lines to relieve the buildup of pressure. The dispensing valve automatically resets, i.e. closes, to prevent the leakage of product from the nozzle.

20 Claims, 7 Drawing Sheets

(51) Int. Cl.

| | |
|---|---|
| *B05B 1/32* | (2006.01) |
| *B05B 9/04* | (2006.01) |
| *B05B 9/047* | (2006.01) |

(56) References Cited

U.S. PATENT DOCUMENTS

| | | | | |
|---|---|---|---|---|
| 6,092,551 | A * | 7/2000 | Bennett | F16K 15/147 137/843 |
| 6,290,992 | B1 * | 9/2001 | Magnuson-Hawkins | A01N 25/16 424/405 |
| 7,172,096 | B2 * | 2/2007 | O'Dougherty | G05D 16/2013 222/1 |
| 8,292,128 | B2 * | 10/2012 | Hagleitner | A47K 5/16 222/190 |
| 8,770,440 | B2 * | 7/2014 | Lin | A47K 5/16 222/180 |
| 8,783,511 | B2 * | 7/2014 | Snodgrass | A47K 5/1217 222/181.3 |
| 8,978,939 | B2 * | 3/2015 | Bull | B65D 47/2031 222/490 |
| 2006/0011655 | A1 * | 1/2006 | Ophardt | A47K 5/16 222/190 |
| 2010/0270328 | A1 | 10/2010 | Quinlan | |
| 2012/0267396 | A1 * | 10/2012 | Quinlan, Jr. | A47K 5/14 222/190 |
| 2013/0032614 | A1 * | 2/2013 | Babikian | B01F 5/0693 222/190 |
| 2013/0200098 | A1 * | 8/2013 | Li | A47K 5/16 222/52 |
| 2015/0327730 | A1 * | 11/2015 | McNulty | A47K 5/14 222/1 |

* cited by examiner

PRODUCT DISPENSER WITH PRESSURE RELIEF

RELATED APPLICATIONS

This patent application claims priority to patent application Ser. No. 61/993,816, titled PRODUCT DISPENSER WITH PRESSURE RELIEF, filed on May 15, 2014 which is incorporated herein by reference in its entirety.

FIELD OF THE INVENTION

The current invention relates generally to fluid product dispensers and in particular to systems and methods of relieving pressure generated within the dispenser system.

BACKGROUND OF THE INVENTION

It is known in the art to dispense hand care products from a dispenser mounted to a wall or dispenser stand. Dispensers may be conveniently located in building entrances, bathrooms, or lunchrooms providing convenient access to passersby. Many dispensers have reservoirs that are open to the atmosphere. Such reservoirs are easily and inexpensively refilled from bulk soap stored in bottles or jugs. However, studies have shown that over time soap containers open to the atmosphere generate unsanitary bio-films. Soap used from these containers actually deposit germs onto the hands of the user during use. Even after cleaning the reservoir, remediation studies have determined that bio-films regenerate despite using strong oxidizers like bleach.

To overcome the detriments of open top dispensers, the reservoir in certain types of dispensers is not refilled when the system is replenished. These systems receive disposable refill units produced in a sanitary environment. When empty of product, the whole reservoir is replaced along with the accompanying nozzle and pump. Accordingly, every part wetted by soap is disposed of when the dispenser is serviced. This greatly reduces and/or eliminates the germination of bio-films.

Sanitary-sealed dispensers are designed in a variety of ways that best meet the needs of the end user. Some dispensers include an enclosed housing, which protects and obscures access to the replaceable reservoir. Dispensers of this type include structural components that close upon themselves to form the housing. The housing components may latch together and unlock to provide access to the refill unit along with other dispenser components contained therein. Such dispensers are self-contained and may be mounted to a wall or dispenser stand. In counter mounted dispensers, the reservoir of fluid product is remotely stored away from the point of distribution. In these types of systems, the nozzle is incorporated into a faucet mounted proximal to a sink or washbasin. Consequently, the remaining components of the system, including the replaceable reservoir, are stored out of sight typically underneath the counter.

Some dispensers are designed with a manually actuated pump where the user pushes or pulls a lever to dispense a quantity of fluid product into the user's hands. However, this requires direct contact by the user, which may further contribute to the transmission of germs. As an alternative, "Hands-free" dispensers activate automatically without direct contact by the user. For these types of dispensers, the user places their hand underneath the dispenser where a sensor is located. The sensor signals an onboard controller that the user's hands are properly positioned and subsequently the controller dispenses a quantity of fluid.

For any of these types of systems, dispensers often leak product from the end of the nozzle after the dispenser pump has been activated. To deliver product, pressure is generated within the dispenser conduits by the actuation of a pump, which forces the fluid out of the nozzle onto the user's hands. However, in current state-of-the-art systems, pressure in the system is typically not relieved after dispenser actuation. As such, fluid product dribbles from the end of the nozzle. This results in wasted product and moreover contributes to an unsightly washroom setting. What is needed is a dispensing system that cleanly cuts off the stream of dispensed fluid product at the end of the dispensing cycle. The embodiments of the subject invention obviate the aforementioned problems.

SUMMARY OF THE INVENTION

In one embodiment of the subject invention a system for dispensing foamed product includes: a housing for supporting one or more components of the system, a product dispensing nozzle received by or within the housing, a reservoir for storing liquid product which may be soap, sanitizer or other foamable product, a foam generating device operatively connected between the reservoir and the product dispensing nozzle, wherein the foam generating device is operatively connected to a source of pressurized air, a control system having one or more outputs, a pump operatively connected to convey liquid product from the reservoir to the foam generating device where the pump is actuated by an output of the controller, an air valve operatively connected to the foam generating device for selectively relieving air pressure in the system where the air valve is actuated by an output of the controller and a valve operatively connected to an upstream side of the product dispensing nozzle where the valve has an open state for allowing the foamed product to flow to the nozzle and a closed state for the sealing the upstream side of the nozzle with respect to the atmosphere.

In one aspect of the embodiments of the subject invention, the valve is a self-actuating valve that opens when pressurized with product, which may be foaming product, and closes when pressure from the foaming product is relieved.

In another aspect of the embodiments of the subject invention, the valve is a self-actuating valve that is at least partially constructed from elastomeric material and the valve includes first and second elastomeric portions that are biased together to form the closed state of the valve and the first and second elastomeric portions of the valve deflect when pressurized with product, which may be foaming product, to form the open state of the valve.

In yet another aspect of the embodiments of the subject invention, the valve is an electrically controlled valve, which may be solenoid valve, that is actuated by the controller.

In still another aspect of the embodiments of the subject invention, the air pump is a diaphragm pump.

In another embodiment of the subject invention, a system for dispensing an associated product includes: a housing for supporting one or more components of the system, a product dispensing nozzle received by the housing, a replaceable reservoir for storing associated liquid product, a control system having one or more outputs, a pump operatively connected to pressurize associated liquid product drawn from the replaceable reservoir for delivery through the nozzle where the pump is actuated by an output of the controller, a self-actuating valve operatively connected to an upstream side of the product dispensing nozzle, the self-actuating valve including a dome-shaped valve head constructed from elastomeric material where the valve head displaces axially to open the valve when pressurized by associated liquid product and automatically closes when pressure from the associated liquid product is relieved, and a pressure-relieving valve operatively connected between an outlet of the pump and the self-actuating valve for relieving pressure therebetween.

In still another embodiment of the subject invention, a method of dispensing foaming product includes the steps of: 1.) providing a dispensing system having a nozzle for dispensing foaming product, a mixing chamber having inlets for receiving air and liquid product, the mixing chamber also including an element for turbulently mixing the air and the liquid product to generate foaming product, an air pump for pressurizing air and a conduit operatively connected between the pump and the mixing chamber, a pressure relief device operatively connected to relieve air pressure in the dispensing system, 2.) activating the air pump to generate foaming product, 3.) deactivating the air pump and 4.) engaging the pressure relief device to relieve air pressure in the dispensing system.

In one aspect of the embodiments of the subject invention, the method includes: providing a self-actuating valve operatively connected between the mixing chamber and the nozzle where the self-actuating valve automatically opens when foaming product is generated, and engaging the pressure relief device to relieve air pressure in the dispensing system whereafter the self-actuating valve automatically closes to seal the upstream side of the nozzle with respect to the atmosphere thereby preventing residual foaming product from exiting the nozzle.

In yet another aspect of the embodiments of the subject invention, the method includes: providing a dispensing system that includes a replaceable liquid product reservoir, a liquid pump operatively connected to the replaceable liquid product reservoir and the mixing chamber and activating the air pump and the liquid pump to generate foaming product and deactivating the air pump and the liquid pump.

DETAILED DESCRIPTION

Figure 1:
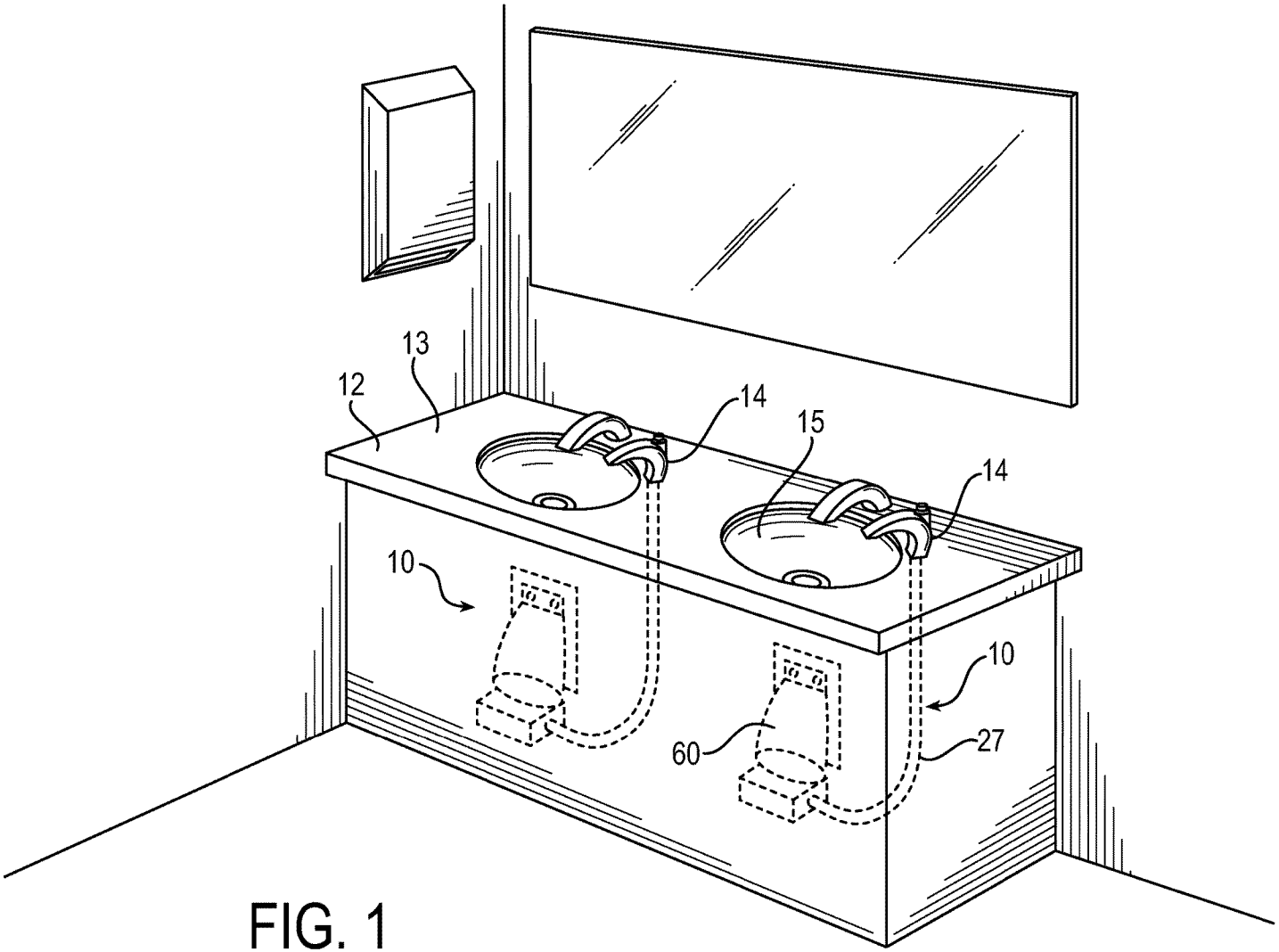
FIG. 1 depicts a counter mounted fluid dispensing system according to the embodiments of the subject invention.

A product dispensing system, depicted in FIG. 1, dispenses a measured amount of fluid product according to the embodiments of the subject invention. In one exemplary instance, the dispensing system, shown generally at 10, dispenses hand care products like soap, lotion or hand sanitizer, although other types of fluid and/or granular products may be similarly dispensed from the dispensing system 10.

Figure 2:
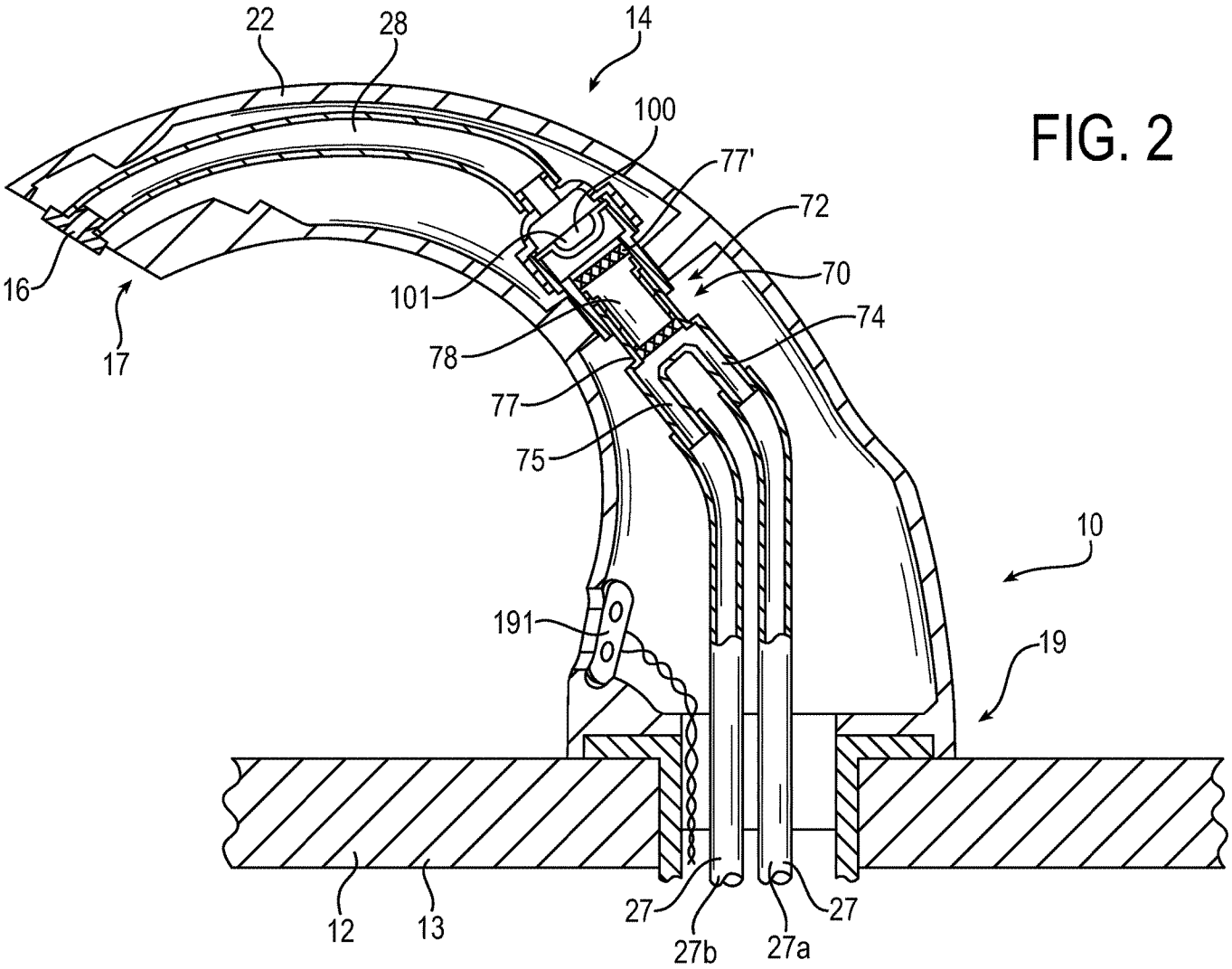
FIG. 2 is a cross sectional view of a fixture comprising fluid conduits and a nozzle, according to the embodiments of the subject invention.

In the embodiment depicted in FIGS. 1 and 2, the dispensing system 10 includes a generally rigid fixture 14 having a product dispensing nozzle 16 received in an end 17 thereof. The fixture 14 may be mounted to a supporting structure 12, like for example a countertop 13, and positioned adjacent a source of clean water and a sink 15. It is noted that the fixture 14 may be mounted to other types of supporting structures, like a wall or dispenser stand. In one embodiment, fixture 14 has a faucet-like configuration including: a base 19 for mounting it to the supporting structure 12 and a cantilevered arm 22. The nozzle 16 may be positioned at the distal end of the cantilevered arm 22. Conduits 27 in the fixture 14 are fluidly connected to a source of product, i.e. reservoir 60, designed in one particular embodiment to be replaced when empty of product, although other embodiments are contemplated where the reservoir 60 may be refilled.

Figure 1A:
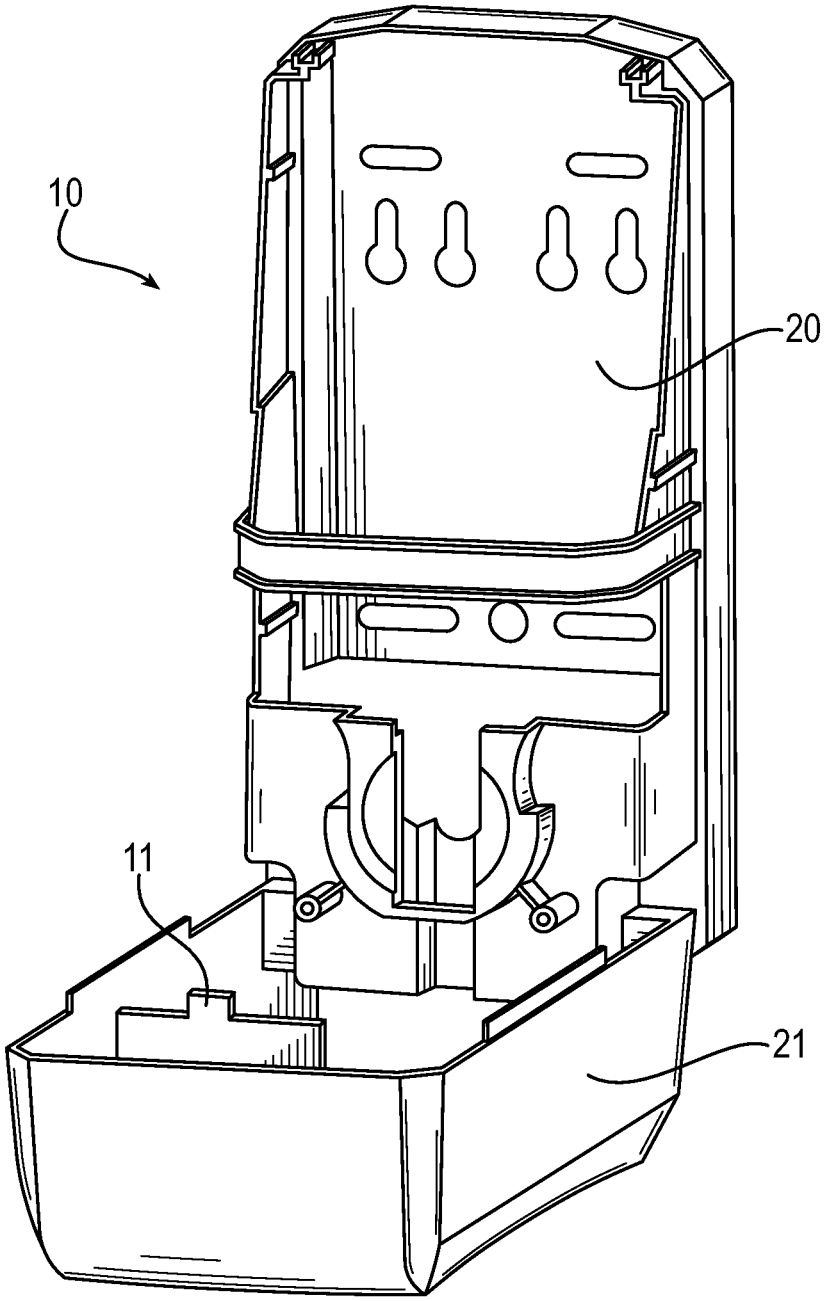
FIG. 1*a* depicts a wall mounted fluid dispensing system according to the embodiments of the subject invention.

It is noted that the embodiments described herein relate generally to counter mounted dispensing systems. However, it is to be construed that the novel aspects of the invention described in this specification relate equally to self-contained wall-mounted dispensing systems, as well as other dispensing systems that pressurize product for distribution through a nozzle. It is noted for wall-mounted dispensing system that the housing may include first and second housing portions 20,21 that close together to encapsulate the components of the dispensing system. A latch 11 may be incorporated for holding the first and second housing portions 20,21 in fixed relationship to each other, reference FIG. 1*a*.

With reference back to FIGS. 1 and 2, internally, the fixture 14 may be at least partially hollow comprising one or more generally concave parts that fasten together to form a fixture assembly. One or more fluid conduits 27 may be received in the hollow interior for protection against damage from direct contact. As such, the fixture 14 may be constructed from impact resistant plastic or corrosion resistant metal. Fasteners or other means of affixing the concave parts together, not shown, may be chosen with sound engineering judgment. Alternative embodiments are contemplated where the fixture 14 may be generally solid formed as a single piece having fluid channels molded or machined directly therein.

Figure 3:
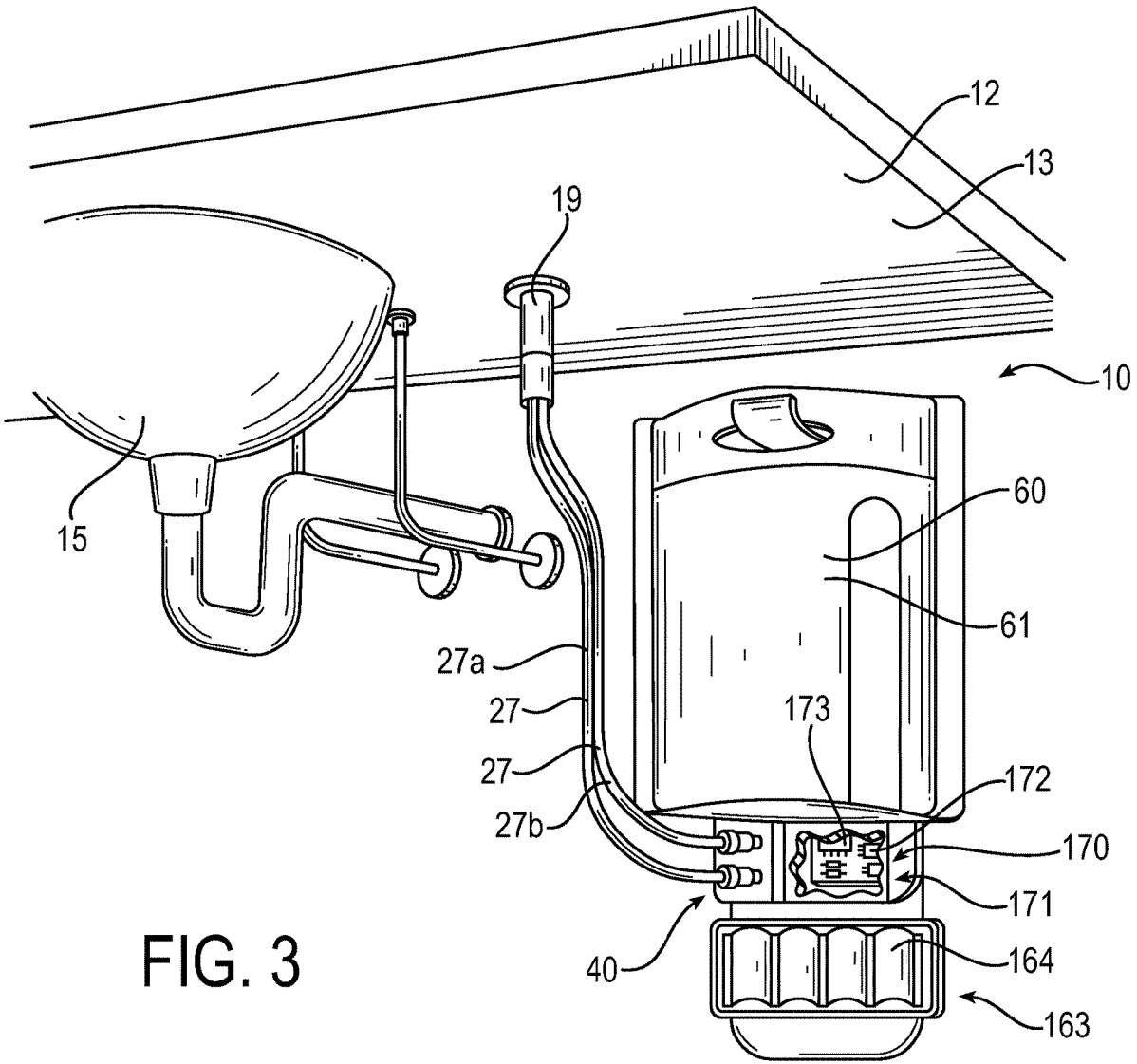
FIG. 3 is a perspective view of the fluid dispensing system showing the refill reservoir, according to the embodiments of the subject invention.

With reference now to FIG. 3, the dispensing system 10 includes a source of fluid product or fluid reservoir 60, as mentioned above. In one embodiment, the fluid reservoir 60 is constructed from pliable material formed as a bag which collapses upon itself when empty of product. In other embodiments, the container comprising the fluid reservoir 60 is constructed from rigid or semi-rigid material, which substantially maintains its original shape as product is dispensed from the container. Notably, the container in this embodiment may include fold lines which cause the container to collapse in a controlled manner. Alternatively, the fluid reservoir 60 may be vented. That is to say that air may be allowed to flow into the reservoir 60 to replace product being dispensed therefrom. All such configurations of fluid reservoir 60 are to be construed as falling within the scope of coverage of the claimed invention.

Figure 4:
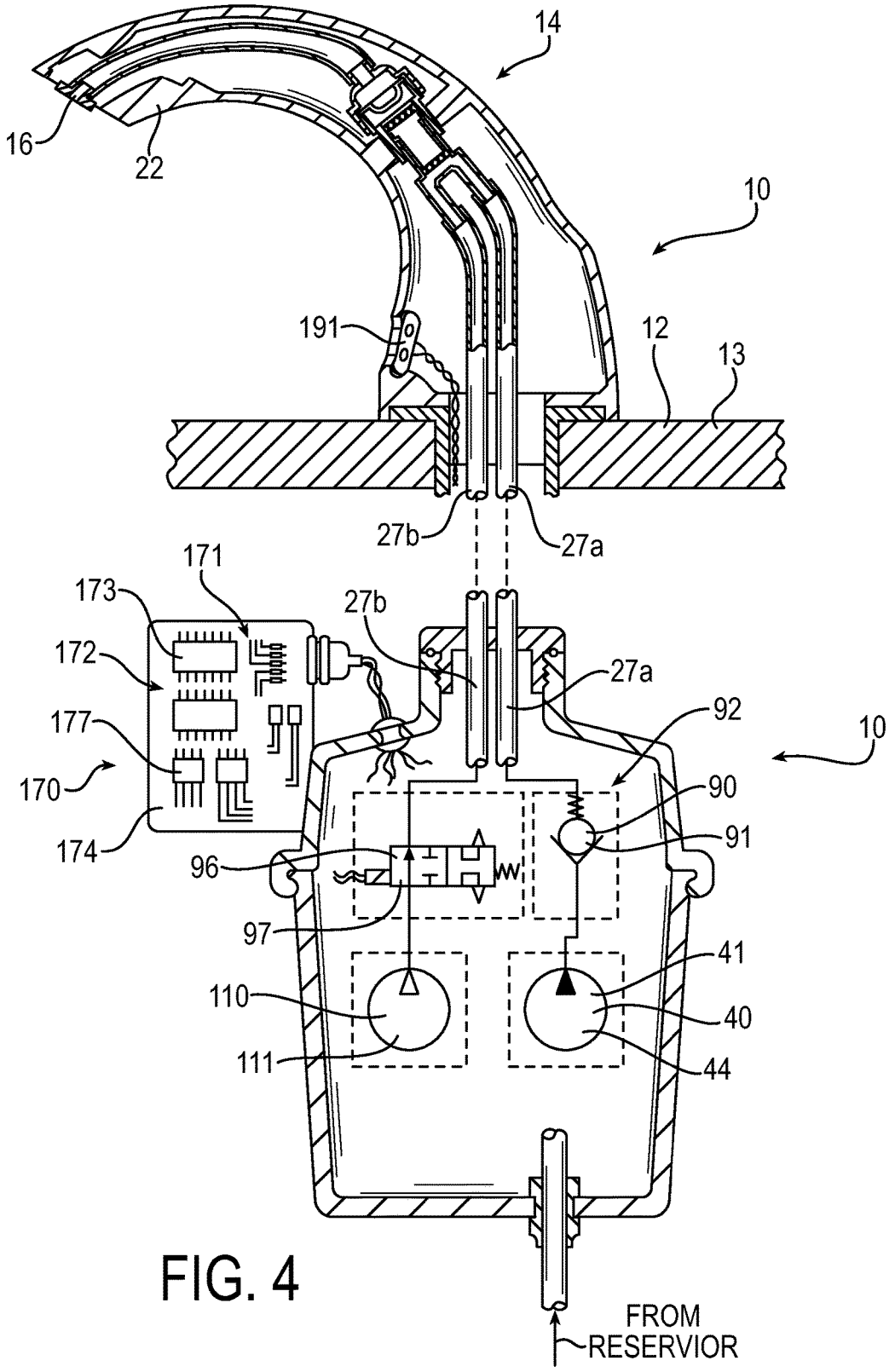
FIG. 4 is a schematic representation of the dispensing system showing the flow and control of product through the system, according to the embodiments of the subject invention.

Referencing FIGS. 2 and 3, persons of skill in the art will understand that product stored in the reservoir 60 may be channeled through conduit(s) 27 by a pumping mechanism 40 (depicted schematically in FIG. 4). The pumping mechanism 40 may use mechanical action to pressurize and thus force fluid through the conduit(s) 27. Specifically, the pumping mechanism 40 may comprise a positive displacement pump 41, which traps a fixed amount of product and forces the product through an outlet of the pump. In one particular embodiment, pumping mechanism 40 comprises a diaphragm pump 44 designed and constructed to displace liquid. However, other types of positive displacement pumps may be chosen with sound judgment of those skilled in the art. Still, other types of pumping mechanisms, or even gravity feed systems, may be employed to channel product through the conduit(s) 27 without departing from the intended scope of coverage of the embodiments of the subject invention.

It follows that the reservoir 60, also referred to herein as refill bag 61, incorporates an outlet connection fitting, not shown in the figures. The outlet connection fitting may be incorporated into the material comprising the refill bag 61 via any process known in the art, as long as a fluid tight seal is ensured. A hose, also not shown in the figures, may extend at a first end from the outlet connection fitting. At its distal end, the hose may connect to an inlet of the pumping mechanism 40 or alternatively may connect to a manifold that is fluidly connected to the inlet of the pumping mechanism 40. It is noted that the manner in which the reservoir 60 is fluidly communicated to the inlet of the pumping mechanism 40 is not to be construed as limiting. Any type of fluid connection may be used that does not leak or expose the fluid product to air.

With reference again to FIG. 2, as mentioned above, the dispensing system 10 delivers product through the nozzle 16 mounted in one end of the fixture 14. In one particular embodiment, product delivered via the nozzle 16 may comprise a foamed fluid product. Persons of ordinary skill in the art will understand that when pressurized air is turbulently mixed with a substance in the liquid phase, air bubbles become trapped within the fluid thereby creating a foamed mixture, referred to herein as foam. Accordingly, the dispensing system 10 may include a foaming device 70 that combines fluid and pressurized air to create the foam.

In one exemplary configuration, the foaming device 70 incorporates a generally cylindrical mixing chamber 72. The first end of the mixing chamber 72 may be fluidly connected to first and second inlets 74, 75 respectively. The first mixing chamber inlet 74 may be communicated with conduit 27*a* in a fluid tight manner, which at its distal end is connected to the outlet of pumping mechanism 40. As such, fluid from the reservoir 60 is delivered to the mixing chamber 72 under pressure. Similarly, the second mixing chamber inlet 75 may be connected to a source of pressurized air 110 via the conduit 27*b*. Both fluid and pressurized air enter into the mixing chamber 72 through an element or elements that causes the flow of both substances to mixed turbulently. In one embodiment, the element causing turbulent mixing may comprise a screen element 77 extending across the first open end of the mixing chamber 72. A hollow region 78 is positioned immediately downstream of screen element 77. In this region 78, air and liquid continue to mix before passing through a second screen element 77'. It will be readily seen that as liquid and air continue to flow into the mixing chamber 72 through the inlets 74, 75, a continuous stream of foam will be created and expelled through the distal second end of the mixing chamber 72. It is expressly noted that the use of screen elements 77, 77' to create foam represents just one embodiment of a foaming device. Alternative embodiments of foaming devices may be incorporated into the dispensing system 10 which include, but are not limited to, other types of mesh or interlaced structural elements that define a torturous path through which combined streams of air and liquid flow.

With reference now to FIG. 4, the conduit connecting the first mixing valve inlet 74 to the outlet of the pumping mechanism 40 may include one or more flow directing valves 90. In one preferred embodiment, flow directing valve 90 may comprise a check valve 91. In a manner known in the art, check valves ensure the flow of fluid through the valve in only one direction. In the current embodiment, check valve 91 is oriented so that fluid only flows from the pumping mechanism 40 to the mixing chamber 72. Check valve 91 may be biased with a spring element 92 having a predetermined spring-bias force. Before fluid can begin to flow, the force of the spring element 92 must be overcome. As such, the pumping mechanism 40 must generate a minimum threshold of pressure to overcome the spring biased force on the check valve 91. In this way, a minimum fluid operating pressure within the system is ensured and the back flow of fluid is eliminated.

Still referencing FIG. 4, second mixing chamber inlet 75 receives pressurized air which combines with fluid from the reservoir 60 in a manner described above. Air traveling through conduit 27*b* emanates from a source of pressurized air, which may comprise a compressor or other pneumatic pumping device. In one embodiment of the subject invention, the source of pressurized air 110 consists of a diaphragm pump 111. The diaphragm pump 111 may include a solenoid for electrically actuating the pump 111. A mechanical reciprocating element, actuated by the solenoid, flexes the diaphragm and thereby generates pressurized air. In that the construction and operation of diaphragm pumps are known in the art no further explanation will be offered at this time.

Pressurized air directed through conduit 27*b* may flow through one or more pneumatic flow directing valves 96. In one particular embodiment, pneumatic flow directing valve 96 may be constructed to selectively: convey pressurized air through conduit 27*b* to the mixing chamber 72 or relieve pressure in the system by venting the air to atmosphere. As such, pneumatic flow directing valve 96 may comprise a pressure relief valve 97. An electrical actuator (which may be a solenoid) incorporated into the valve 97 may allow or cause a spool or poppet to be shifted between first and second operating states. In this way, the pressure relief valve 97 can be actuated remotely, via a control system 170, to relieve back pressure in the conduit 27*b* or allow pressurized air to flow into the mixing chamber 72. It is expressly noted that other forms of pressure relieving devices may be employed. All such devices are to be construed as falling within the scope of the claimed invention.

With reference again to FIG. 2, an outlet of the foaming device 70 is positioned downstream from the mixing chamber 72 and upstream from the nozzle 16, as illustrated in the figures. The outlet is configured to receive a dispensing valve 100, which is connected to the first end of a conduit 28 in a fluid tight manner. The distal end of conduit 28 is similarly connected to the nozzle 16. The dispensing valve 100 opens to allow product to be dispensed onto the user's hands in a manner consistent with that described above and closes to prevent residual product within conduit 28 from leaking or dribbling out of the nozzle 16 after a dispense event has occurred.

The dispensing valve 100 may comprise a self-closing dispensing valve 101. By self-closing it is meant that the dispensing valve 101 automatically opens and closes responsive to pressure generated within the foaming device 70. More specifically, the self-closing dispensing valve 101 opens when product having a predetermined threshold of pressure impinges on the dispensing valve. In a corresponding manner, dispensing valve 101 closes when pressure on the valve is removed. It is expressly noted that in the current embodiment dispensing valve 101 is not directly actuated by control system 170. However, alternative embodiments are contemplated where dispensing valve 101 is actuated by a controller, which may incorporate the use of one or more sensors. In any instance, dispensing valve 100 (or self-closing dispensing valve 101) functions to draw in at least a portion of the residual product remaining in conduit 28 when the dispensing valve 100 closes. In this manner, any product still remaining in the conduit 28 and/or in the nozzle 16 after a dispense event is prevented from leaking or dribbling out of the nozzle 16.

Figure 5:
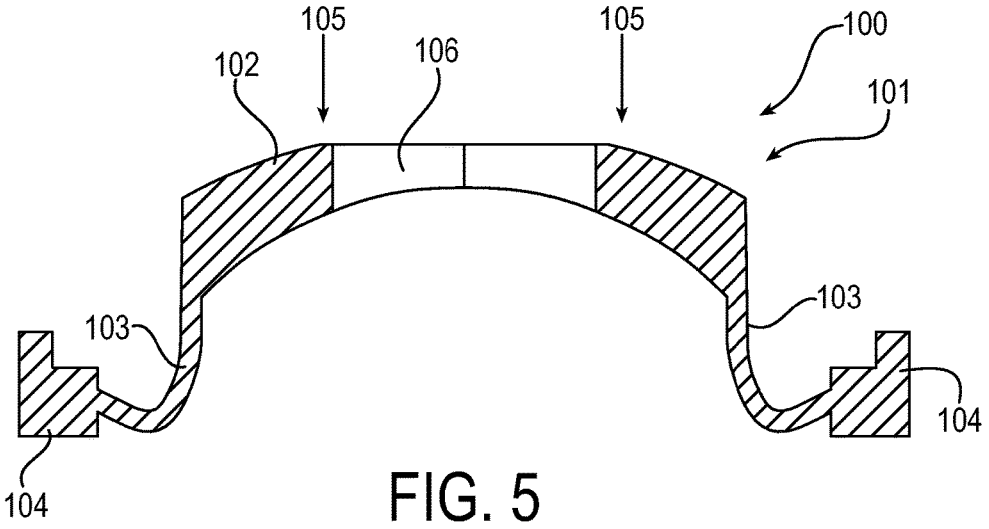
FIG. 5 is a cross sectional view of a dispensing valve in a first closed state, according to the embodiments of the subject invention.
Figure 5A:
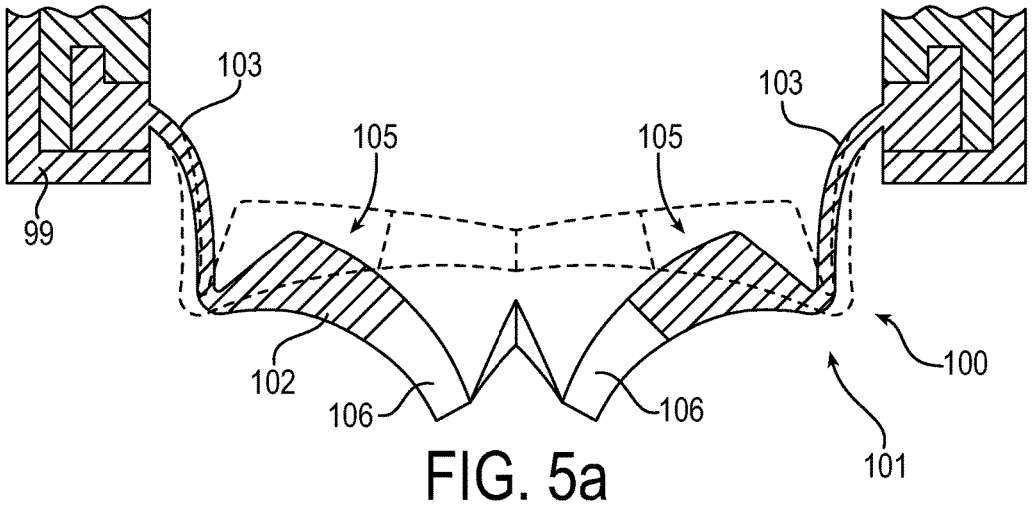
FIG. 5*a* is a cross sectional view of a dispensing valve in a second open state, according to the embodiments of the subject invention.

With reference now to FIGS. 5 and 5*a*, in one preferred embodiment, self-closing dispensing valve 101 is comprised of resiliently elastic material, which may be polymeric material, examples of which may include but are not limited to: silicone and/or latex-based materials. The dispensing valve 101 may be integrally fashioned as a monolithic component, which is to say that the dispensing valve 101 is not assembled from multiple parts. In particular, the dispensing valve 101 may be molded as a singular component in a thermoplastic or thermoset process. However, other forming processes may be chosen with sound judgment of those skilled in the art.

The dispensing valve 101 may include a generally convex valve head 102 and one or more sidewalls 103. The sidewalls 103 extend from a peripheral edge of the valve head 102 and terminate at its distal end, which has a contour suitable for holding the dispensing valve 101 in a fluid tight relationship with the outlet of foaming device 70. In one particular embodiment, the distal ends of sidewalls 103 comprise a flange 104 having stepped surfaces designed to hold the dispensing valve 101 in place by a retaining member 99 shown schematically in FIG. 5*a*. Notably, the specific configuration of said distal end of sidewalls 103 is not to be construed as limiting in any manner. Other configurations may be employed as desired.

The sidewalls 103 may be constructed having a wall thickness and a durometer suitable for allowing the valve head 102 to displace axially (i.e. axially with respect to the outlet of the foaming device 70) in response to fluid pressure impinging a first side 105 thereof. In a manner consistent with that described above, the sidewalls 103 are so constructed such that the resiliently elastic nature of the material causes the valve head 102 to return to its original position (See FIG. 5) when pressure is removed from impinging on the first side 105 of the dispensing valve 101. It will be appreciated by those skilled in the art that the particular thickness and durometer of the material of the sidewalls 103 may vary with the dimensional configuration of the outlet of the foaming device 70 as well as the particular type of product (i.e. product viscosity and/or density) being dispensed from the dispensing system 10. All such variations are to be construed as falling within the scope of coverage of the claimed invention provided that the dispensing valve 101 functions in a manner consistent with the description disclosed herein.

Still referring to FIGS. 5 and 5*a*, the self-closing or self-actuating dispensing valve 101 may include one or more discontinuities or breaks in the material at a center portion 106 of the valve head 102. The discontinuities comprise slits or cuts in the material, which may be formed during the molding of the dispensing valve 101 and/or applied to the valve head 102 in a subsequent manufacturing process. In one particular embodiment, two linear slits are formed in the valve head 102 that cross each other in a substantially perpendicular orientation, referred to herein as a slit valve. Skilled artisans will understand that a fewer or greater number of slits may be fashioned in the dispensing valve 101 and the slits may be fashioned at any angle chosen with sound judgment. Moreover, it is to be construed that the linear nature of the slits and the angular orientation of one slit with respect to another may vary without departing from the novel aspects of the invention described herein.

From the aforementioned it will be readily observed that in the un-deflected state, the slits fashioned in the valve head 102 are closed to form a barrier against the passage of product through the dispensing valve 101. In a corresponding manner, when pressurized by product emanating from the mixing chamber 72, the valve head 102, which may be dome shaped, will displace axially in an inverted fashion causing the slits to move apart and the dispensing valve 101 to open thereby allowing the passage of product therethrough. It is noteworthy to mention here that as the valve head 102 returns to its original position, as will happen after a dispense event occurs, residual fluid product remaining in conduit 28 will be drawn away from the nozzle 16. Negative pressure generated in the conduit 28 at that time will prevent residual fluid product from leaking or dribbling out of the nozzle 16.

With reference again to FIGS. 3 and 4, dispensing system 10 includes a control system 170 comprising one or more electronic circuits 171 for controlling the sequence of operation of the dispensing system 10. The electronic circuitry 171 may reside on a printed circuit board 174 and may be housed in a suitable enclosure, not shown.

An electrical power supply 163 may be provided to power the electronic circuits 171. In one embodiment, mains AC power is available on site from the facility in which the dispensing system 10 is installed. In another embodiment, power may be provided by way of an onboard power source, like for example a battery 164, or alternatively from photoelectric cells, not shown. In the embodiment depicted, the onboard power supply is comprised of one or more batteries 164, and more specifically four (4) D-cell batteries. However, the quantity, type and configuration of the batteries are not to be construed as limiting in any way.

The electronic circuitry 171 of the control system 170 may comprise digital electronic circuitry 172 designed to receive and process data relating to operation of the dispensing system 10. In particular, the digital electronic circuitry 172 functions to generate output signals that activate the pumping mechanisms and flow control valves. In one embodiment, the digital electronic circuitry 172 may comprise one or more logic processors 173, which may be programmable to execute a sequence of coded instructions. Circuitry 172 may further include electronic non-volatile data storage and/or volatile memory 177 use to store signal-commands for operating the dispensing system 10. Accordingly, the control system 170 can be programmed to activate or deactivate the components of the dispensing system 10

(e.g. pneumatic or fluidic pumping mechanisms 40, 100 and/or flow directing valves 90, 96) in a particular sequence as is suitable for operating the dispensing system 10 to be discussed in detail below. Still, persons of skill in the art will understand the use and implementation of a wide array of support circuitry that may be necessary for controlling operation of the dispensing system 10.

In one particular embodiment, sensors 191 may be incorporated into the fixture 14 (reference FIG. 2). These sensors 191 are used to detect motion for hands-free activation of the dispensing system 10. The sensors 191 may comprise one or more IR emitters and detectors. The emitter-detector pairs may be oriented in a manner that ensures consistent activation within a particular region under the nozzle 16. It follows that the controller 170 is functional to receive input from the sensors 191 and is capable of initiating a dispense event in response to the sensor feedback.

Figure 6:
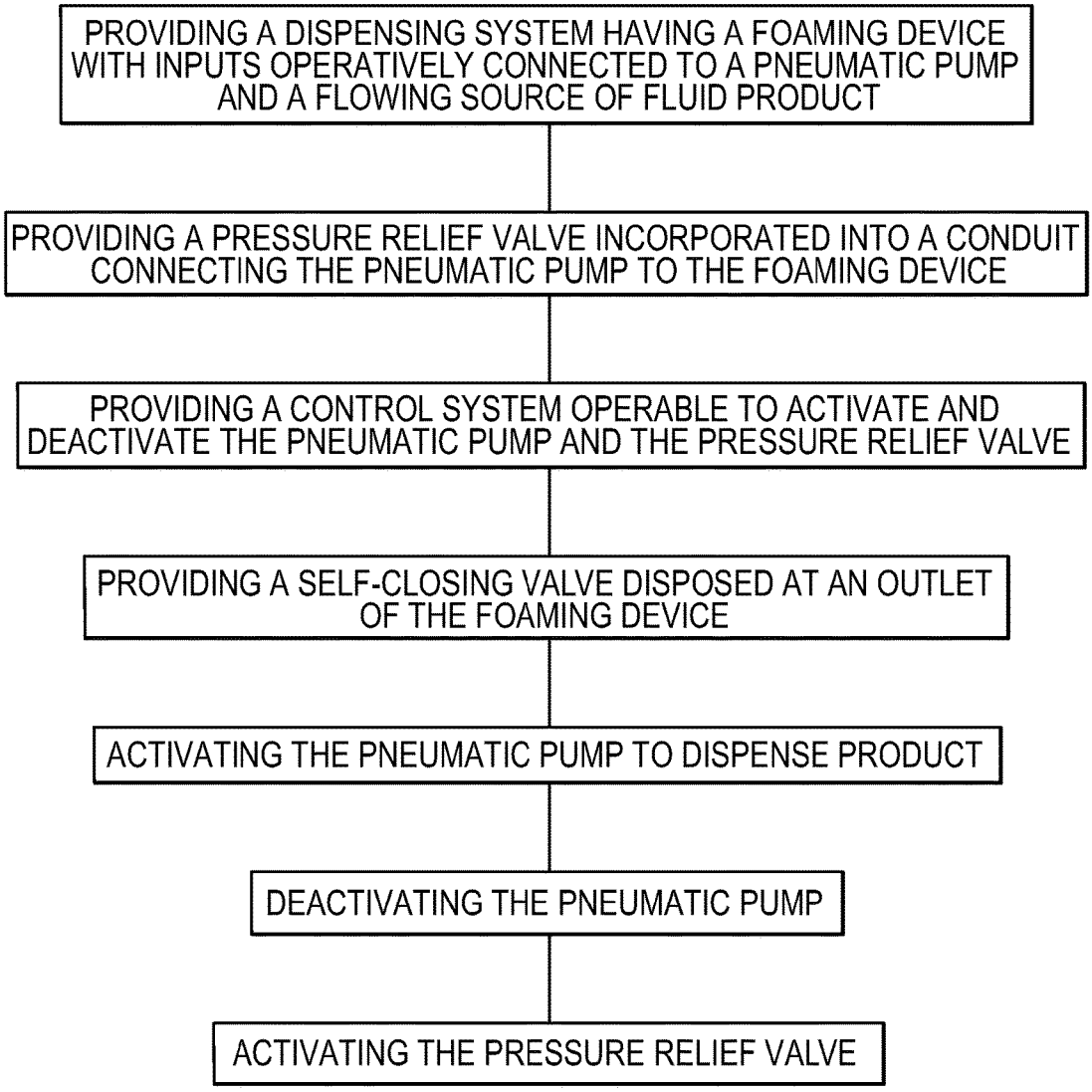
FIG. 6 is a block diagram of a method of operating the dispensing system, according to the embodiments of the subject invention.

With reference now to FIG. 6, the control system 170 may activate and deactivate the components of the system 10, (i.e. pneumatic or fluidic pumping mechanisms 40, 100 and/or flow directing valves 90, 96) in a particular order to facilitate the dispensing of product onto the user's hands. In one embodiment, a dispense event is initiated when a user places his or her hands in proximity to the fixture 14 in the region of the sensors 191. The sensors 191 detect the user's presence and send a signal to the control system 170. Control logic (e.g. software, firmware and/or hardwired logic) within the control system 170 receives the sensor input and initiates activation of the system components. Of course, skilled artisans will understand that the novel aspects of the claimed invention extend to manually actuated dispensing systems 10 equally as well.

In one embodiment, the control system 170 will begin the dispensing cycle by actuating the pneumatic and fluidic pumping mechanisms 40, 100. The pumping mechanisms 40, 100 may be actuated substantially simultaneously. However, depending on the specific type of pumping mechanisms used, one of the pneumatic or fluidic pumping mechanisms 40, 100 may be actuated before the other to ensure that the desired consistency of foam product is delivered by the system 10. The control system 170 may operate the pumping mechanisms 40, 100 for a length of time sufficient to distribute a predetermined amount of product, which in one embodiment is approximately 1 fluid ounce. Upon activation of the pumping mechanisms 40, 100 product from the reservoir 60 will be pumped into the mixing chamber 72 along with pressurized air. The combined mixture will further generate pressure at the first side 105 of the dispensing valve 100 causing the valve head 102 to shift axially to the inverted position (shown in FIG. 5*a*) thereby opening the center portion 106 of the valve 100 to allow product to flow through the nozzle 16.

The control system 170 may then disengage the pumping mechanisms 40, 100 and subsequently engage the pressure relief valve 97. In one embodiment, the pressure relief valve 97 may be engaged shortly after the pumping mechanisms 40, 100 have been turned off. The term "shortly after" references an amount of time, which in one embodiment is about 10 milliseconds (10 ms). Alternate embodiments are considered where the pressure relief valve is activated between 0 milliseconds (0 ms) and 50 millisecond (50 ms). Still other embodiments are contemplated where the range of time to activate valve 97 is between 0 milliseconds (0 ms) and 500 milliseconds.

The pressure relief valve 97 may be activated for a length of time sufficient to vent pressurized air in conduit 27*b* to the atmosphere and then deactivated whereby the control system 170 is reset until another dispense event is initiated. It will be readily seen that upon deactivation of the pumping mechanisms 40, 100 and activation of the pressure relief valve 97, the valve head 102 will translate axially back to its original position thus closing the center portion 106, which draws fluid inwardly and prevents fluid product from leaking or dribbling out of the nozzle 16.

Having illustrated and described the principles of the dispensing system in one or more embodiments, it should be readily apparent to those skilled in the art that the invention can be modified in arrangement and detail without departing from such principles.

It is claimed:

1. A system for dispensing foamed product, comprising:

a housing for supporting one or more components of the system;

a product dispensing nozzle received by the housing;

a reservoir for storing liquid product;

a mixing chamber operatively connected between the reservoir and the product dispensing nozzle;

a conduit operatively connected to an upstream side of the product dispensing nozzle and a downstream side of the mixing chamber;

a controller having one or more outputs;

a liquid pump operatively connected to convey liquid product from the reservoir to the mixing chamber, wherein the liquid pump is actuated by an output of the controller;

a liquid conduit having a first end and a second end, wherein the first end of the liquid conduit is connected to the liquid pump and the second end of the liquid conduit is connected to the mixing chamber, and wherein liquid pump conveys liquid product through the liquid conduit and into the mixing chamber;

an air pump operatively connected to convey pressurized air to the mixing chamber;

an air valve operatively connected to the mixing chamber for selectively relieving air pressure in the system, wherein the air valve is actuated by an output of the controller; and, a valve operatively connected to an upstream side of the conduit, the valve having an open state for allowing the foamed product to flow to the conduit and a closed state for the sealing the upstream side of the conduit with respect to the atmosphere, wherein the valve moves from the open state to the closed state upon relieving air pressure from the system;

wherein the valve is configured to create a negative pressure in the conduit when the valve moves from the open state to the closed state.

2. The system as defined in claim 1, wherein the valve is a self-actuating valve that opens when pressurized with foaming product and closes when pressure from the foaming product is relieved.

3. The system as defined in claim 1, wherein the valve is a self-actuating valve that is at least partially constructed from elastomeric material, and wherein the valve includes first and second elastomeric portions that are biased together to form the closed state of the valve, and wherein the first and second elastomeric portions of the valve deflect when pressurized with foaming product to form the open state of the valve.

4. The system as defined in claim 1, wherein the valve is a slit valve that includes a dome shaped valve head where the convex side of the valve head faces the upstream side of the foaming product, wherein the valve head is constructed from elastomeric material and includes at least one slit formed in the valve head, and wherein the valve head automatically inverts when pressurized by foaming product to displace the elastomeric material thereby opening the valve.

5. The system as defined in claim 1, wherein the valve is an electrically controlled valve, and wherein the valve is actuated by the control system.

6. The system as defined in claim 1, further comprising: an element for turbulently mixing air and liquid product.

7. The system as defined in claim 1, further comprising: a one-way valve operatively connected between an outlet of the liquid pump and the mixing chamber for allowing liquid flow in a single direction from the liquid pump to the mixing chamber.

8. The system as defined in claim 1, wherein the air valve is an electrically actuated solenoid valve.

9. The system as defined in claim 8, wherein the air valve is operatively connected between an outlet of the air pump and the mixing chamber.

10. The system as defined in claim 1, wherein the air pump is a diaphragm pump.

11. The system as defined in claim 1, wherein the control system is an electrical control system comprising digital electronic circuitry and a logic processor capable of executing a sequence of coded instructions.

12. The system as defined in claim 1, wherein the housing is configured for mounting to an associated countertop.

13. The system as defined in claim 1, wherein the housing is constructed from first and second housing portions that close together to encapsulate the components of the system; and, further comprising a latch for holding the first and second housing portions in fixed relationship.

14. A system for dispensing an associated product, comprising:

a housing for supporting one or more components of the system;

a product dispensing nozzle received by the housing;

a replaceable reservoir for storing associated liquid product;

a control system having one or more outputs;

a liquid pump operatively connected to pump liquid product from the replaceable reservoir for delivery through the nozzle, wherein the replaceable reservoir is upstream from the liquid pump, and wherein the liquid pump is actuated by an output of the controller;

an air pump operatively connected to pump pressurized air for delivery to the nozzle;

a self-actuating valve operatively connected to an upstream side of the product dispensing nozzle, the self-actuating valve including a dome-shaped valve head constructed from elastomeric material, wherein the valve head displaces axially to open the valve when pressurized by associated liquid product and automatically closes when pressure from the associated liquid product is relieved; and, a pressure-relieving valve operatively connected between an outlet of the air pump and the self-actuating valve for relieving air pressure therebetween;

wherein activation of the pressure-relieving valve causes the air pressure to return to atmospheric air pressure after each actuation of the air pump, and wherein activation of the pressure-relieving valve causes the self-actuating valve to close.

15. The system as defined in claim 14, wherein the self-actuating valve is a slit valve having a valve head that includes one or more slits, and wherein the dome-shaped valve head inverts from a convex configuration to a concave configuration when the valve head displaces axially thereby opening the slits to allow fluid flow therethrough.

16. The system as defined in claim 14, further comprising:

a mixing chamber having first and second inlets and an outlet, wherein the first inlet of the mixing chamber is connected by a conduit in a fluid tight manner between the self-actuating valve and the outlet of the pump, wherein the second inlet of the mixing chamber is connected to an associated source of pressurized air, and wherein the outlet of the mixing chamber is connected to the self-actuating valve.

17. A method of dispensing foaming product, comprising the steps of:

providing a dispensing system including:

a nozzle for dispensing foaming product;

a mixing chamber having an air inlet for receiving air and a liquid inlet for receiving liquid product, the mixing chamber also including an element for turbulently mixing the air and the liquid product to generate foaming product;

an air pump for pressurizing air and an air conduit operatively connected between the air pump and the air inlet of the mixing chamber, wherein the air pump pumps air through the air conduit and into the mixing chamber;

a liquid pump for conveying liquid product and a liquid conduit operatively connected between the liquid pump and the liquid inlet of the mixing chamber, wherein the liquid pump conveys the liquid product through the liquid conduit and into the mixing chamber;

a self-actuating valve operatively connected to the downstream side of the mixing chamber;

a pressure relief device operatively connected to relieve air pressure in the dispensing system;

activating the air pump to generate foaming product;

deactivating the air pump; and engaging the pressure relief device to relieve air pressure in the dispensing system after each deactivation of the air pump, wherein the self-actuating valve moves from an open position to a closed position upon relief of the air pressure.

18. The method as defined in claim 17, further comprising the step of:

providing a self-actuating valve operatively connected between the mixing chamber and the nozzle, wherein the self-actuating valve automatically opens when foaming product is generated; and, wherein the step of engaging the pressure relief device to relieve air pressure in the dispensing system, comprises the step of:

engaging the pressure relief device to relieve air pressure in the dispensing system whereafter the self-actuating valve automatically closes to seal the upstream side of the nozzle with respect to the atmosphere thereby preventing residual foaming product from exiting the nozzle.

19. The method as defined in claim 18, wherein the self-actuating valve includes a dome-shaped valve head constructed from elastomeric material, wherein the valve head displaces axially to open when pressurized with foaming product and automatically closes when pressure in the dispensing system is relieved.

20. The method as defined in claim 17, further comprising the steps of:

providing a dispensing system that includes:

replaceable liquid product reservoir; and, a liquid pump operatively connected to the replaceable liquid product reservoir and the mixing chamber;

wherein the step of activating the air pump to generate foaming product comprises the step of:

activating the air pump and the liquid pump to generate foaming product; and, wherein the step of deactivating the air pump, comprises the step of:

deactivating the air pump and the liquid pump.

* * * * *